US006297809B1

(12) United States Patent
Ito

(10) Patent No.: US 6,297,809 B1
(45) Date of Patent: Oct. 2, 2001

(54) KEYBOARD APPARATUS FREE FROM INCORRECT FITTING OF KEY-TOP IN TYPE AND FITTING DIRECTION THEREOF

(75) Inventor: Hideki Ito, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/408,332

(22) Filed: Sep. 29, 1999

(30) Foreign Application Priority Data

Sep. 30, 1998 (JP) ..... 10-294537

(51) Int. Cl.[7] ..... G09G 5/00
(52) U.S. Cl. ..... 345/168; 400/490
(58) Field of Search ..... 345/160, 168, 345/170, 171, 172; 341/20, 22; 400/490, 495, 472

(56) References Cited

U.S. PATENT DOCUMENTS 5,209,588 * 5/1993 Chen ..... 400/490
5,406,277 * 4/1995 Lee ..... 341/22
5,456,541 * 10/1995 Ching Shui ..... 400/495
5,516,996 * 5/1996 Shin ..... 400/490
6,056,457 * 5/2000 Chao ..... 400/490

FOREIGN PATENT DOCUMENTS

HEI 4-126630 11/1992 (JP) .

* cited by examiner

*Primary Examiner*—Regina Liang
(74) *Attorney, Agent, or Firm*—Brinks Hofer Gilson & Lione

(57) ABSTRACT

When plural types of key-switch bodies arranged on a keyboard base are fitted with the corresponding types of key-tops, fitting of an incorrect key-top on a key-switch is avoided. Each key-top has a key-top side assortment cord comprising a unique combination of convex portions and concave portions which is determined by the type thereof, and a housing of each key-switch body has a body side assortment cord comprising a unique combination of convex portions and concave portions engageable with the key-top side assortment cord in pairs. The key-tops can be fitted to the key-switch bodies only when the key-top side assortment cord is brought into engagement with the body side assortment cord.

3 Claims, 6 Drawing Sheets

KEYBOARD APPARATUS FREE FROM INCORRECT FITTING OF KEY-TOP IN TYPE AND FITTING DIRECTION THEREOF

BACKGROUND OF THE INVENTION

1. Field of the Invention

The present invention relates to a keyboard apparatus in which fitting of an incorrect key-top on a key-switch body in the type of the key-top and fitting direction thereof is avoided when each key-top corresponding to each of plural kinds of the key-switch bodies arranged on a keyboard base is fitted thereto.

2. Description of the Related Art

On a keyboard base of a computer, a word processor, etc. numerous key-switches 100 . . . are arranged, as shown in FIG. 6 for example. To these key-switches 100 . . . are fitted key-tops for being pushed by a finger having various shapes in a top view thereof, such as roughly rectangular shapes, half-size shapes, crosswise shapes, odd size L-shapes, etc. Moreover, when taking only the half size shaped key-switch (referred to "a half key" below), as an example, there are subtle differences in the shapes thereof in accordance with arranged positions thereof, as shown by key-switches 100*a*, 100*b*, 100*c*, 100*d*, 100*e*, and 100*f*.

The key-switch generally comprises a key-top 110 and a key-switch body (referred to simply "a body" below) 120, as shown in FIGS. 7A and 7B, as an example. The key-top 110 comprises a top plate 11 being pushed by a finger, a stem portion 12 extending below the top plate 11 through an axis "X" of the key-top 110, a hook portion 13 disposed in the both sides of the stem portion 12 sandwiched therebetween, and a side wall 14 extending below the periphery of the top plate 11.

The body 120 comprises a housing 21 accommodating the body 120, a rubber spring 22 connected to the bottom end of the stem portion 12 having a shape of a bowl inverted on the surface, and a membrane switch 24 disposed underneath a pushing portion 23 of the rubber spring 22, being formed below the center apex of the rubber spring 22. In the housing 21 formed are a socket 25 into which the stem portion 12 is vertically slidably inserted, and a hook holding hole 26 with which the hook portion 13 engages so that the key-top 110 cannot be pulled out from the body 120.

In order to fit the key-top 110 to the body 120, the key-top 110 is oriented relative to the body 120 so that the hook portion 13 engages with the hook holding hole 26 relative to the axis "X"; the end of the stem portion 12 is inserted into the socket 25; and the key-top 110 may be only pushed downward in this state. At this time, the stem portion 12 is connected to the rubber spring 22 by fitting an annular portion 29 of the rubber spring 22 formed upward protrudingly from the center apex thereof into the end of the stem portion 12; simultaneously the end portion of the hook portion 13 is inserted into and brought into engagement with the hook holding hole 26 so as to be not pulled out therefrom; and fitting is completed.

In this key-switch, when the top plate 11 is pushed by a finger, the stem portion 12 slides downward in the socket 25 such that the end of the stem portion 12 pushes the rubber spring 22 downward to buckle it. Thereby, the membrane switch 24 is pushed by the pushing portion 23 so as to be brought into conduction. When the finger is separated from the top plate 11, the key-top 110 returns to the original position thereof by a repulsion force of the rubber spring 22 to thereby turn the membrane switch 24 off.

When the keyboard is assembled, each key-switch body having a specific function is arranged at and assembled in the corresponding position of the keyboard in advance; each key-top corresponding to the body is fitted thereto; and a specific symbol such as an alphabet is printed afterward on the top plate surface of the key-top by a laser for example.

When key-tops having distinct different shapes and sizes are assembled, fitting thereof to each of corresponding bodies is comparatively easy due to easy recognition thereof. However, in order immediately to recognize key-tops having subtle differences in the shapes thereof, as half keys 100*a* to 100*f*, to fit them to corresponding bodies, considerable attention is needed, such that key-tops of the different type are prone to be incorrectly fitted. Once the different type of key-top is incorrectly fitted, it cannot be pulled out because the hook portion 13 engages with the hook holding hole 26 as described above, resulting in decreasing productivity so that it is eliminated from the production line as a failed product, for example.

Even the same type of key-top generally has a shape being unsymmetrical between back and foreground sides of the keyboard surface, so that fitting of key-tops inverting back and foreground sides has been done.

SUMMARY OF THE INVENTION

The present invention solves the above-described problems. Accordingly, it is an object of the present invention to provide a keyboard apparatus in which incorrect fitting in types and fitting directions of key-tops is prevented when plural types of key-tops are fitted to corresponding types of key-switch bodies arranged on a keyboard base.

In order to solve the above-described problems, in a keyboard apparatus according to the present invention, the key-top comprises a key-top side assortment cord formed of a combination of convex portions and concave portions which is determined by the type thereof, and the key-switch body comprises a body side assortment cord formed of a combination of convex portions and concave portions and which is brought into engagement with the key-top side assortment cord in pairs, wherein the key-top can be fitted to the key-switch body only when the key-top side assortment cord is brought into engagement with the body side assortment cord.

In this keyboard apparatus, the key-top can be fitted to the corresponding key-switch body only when the key-top side assortment cord formed of a combination of convex portions and concave portions which is determined by the type of the key-top is brought into engagement with the corresponding body side assortment cord in pairs. Accordingly, another type of key-top having a assortment cord which is not brought into engagement with the body side assortment cord cannot be fitted to the body, resulting in prevention of a mistake in which a different key-top is fitted wrong to the body.

In a keyboard apparatus according to the present invention, the key-top side assortment cord may be formed below a port on of a side wall of the key-top, and the body side assortment cord may be formed above a housing of the key-switch body.

Thereby key-top side and body-side assortment cords are easily formed and cannot be also in sight from outside, resulting in non-loss of design and appearance thereof.

In a keyboard apparatus according to the present invention, the key-top may further comprise a key-top side direction cord for defining the fitting direction disposed in a different position from that of the key-top side assortment cord having a convex portion or a concave portion, and the key-switch body may further comprise a body side direction cord disposed in the engaging position with the key-top side direction cord having a concave portion or a convex portion, and wherein the key-top can be fitted to the key-switch body only when the key-top side direction cord is brought into engagement with the body side direction cord.

Since the key-top can be fitted to the key-switch body only when the key-top side direction cord is brought into engagement with the body side direction cord, the key-top cannot be fitted in the inverted direction.

In a keyboard apparatus according to the present invention, the key-top side direction cord may be formed in the foreground position of the keyboard or the back position thereof.

Thereby the key-top side direction cord is easily formed and cannot be also in sight from outside, resulting in non-loss of design and appearance. Since the direction cord can be visually checked it can be used as a sign for checking the inserting direction of the key-top before insertion.

DESCRIPTION OF THE PREFERRED EMBODIMENTS

Figure 7A:
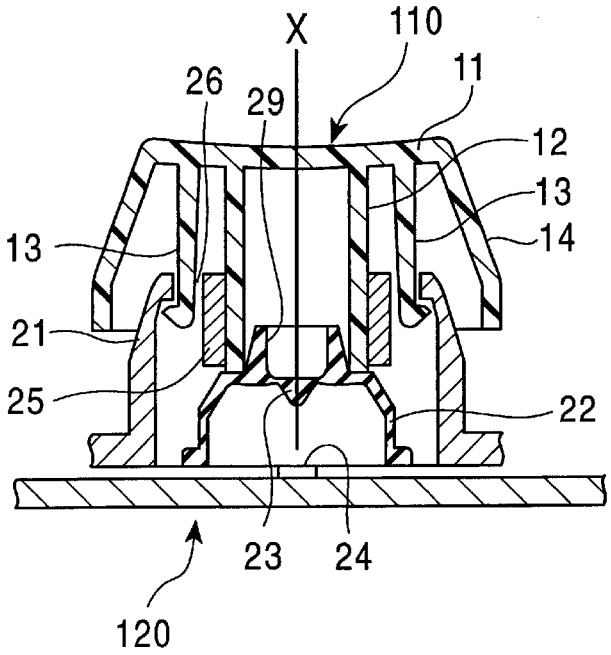
FIG. 7A PRIOR ART
FIG. 7A is a sectional view of an example of a conventional key-switch in its OFF (free) position.
Figure 7B:
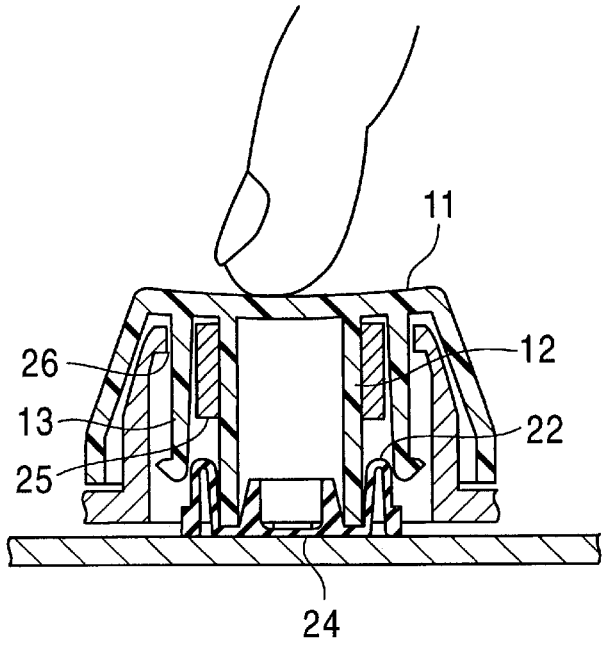
FIG. 7B PRIOR ART
FIG. 7B is a sectional view of the example of the conventional key-switch in its ON (pushed down) position.

Referring to drawings, embodiments of the present invention will be described. Throughout the description below, like reference characters designate like portions having functions common to those of the conventional key-switch described with reference to FIG. 7, and description thereof will be abbreviated or simplified.

(First Embodiment)

Figure 1:
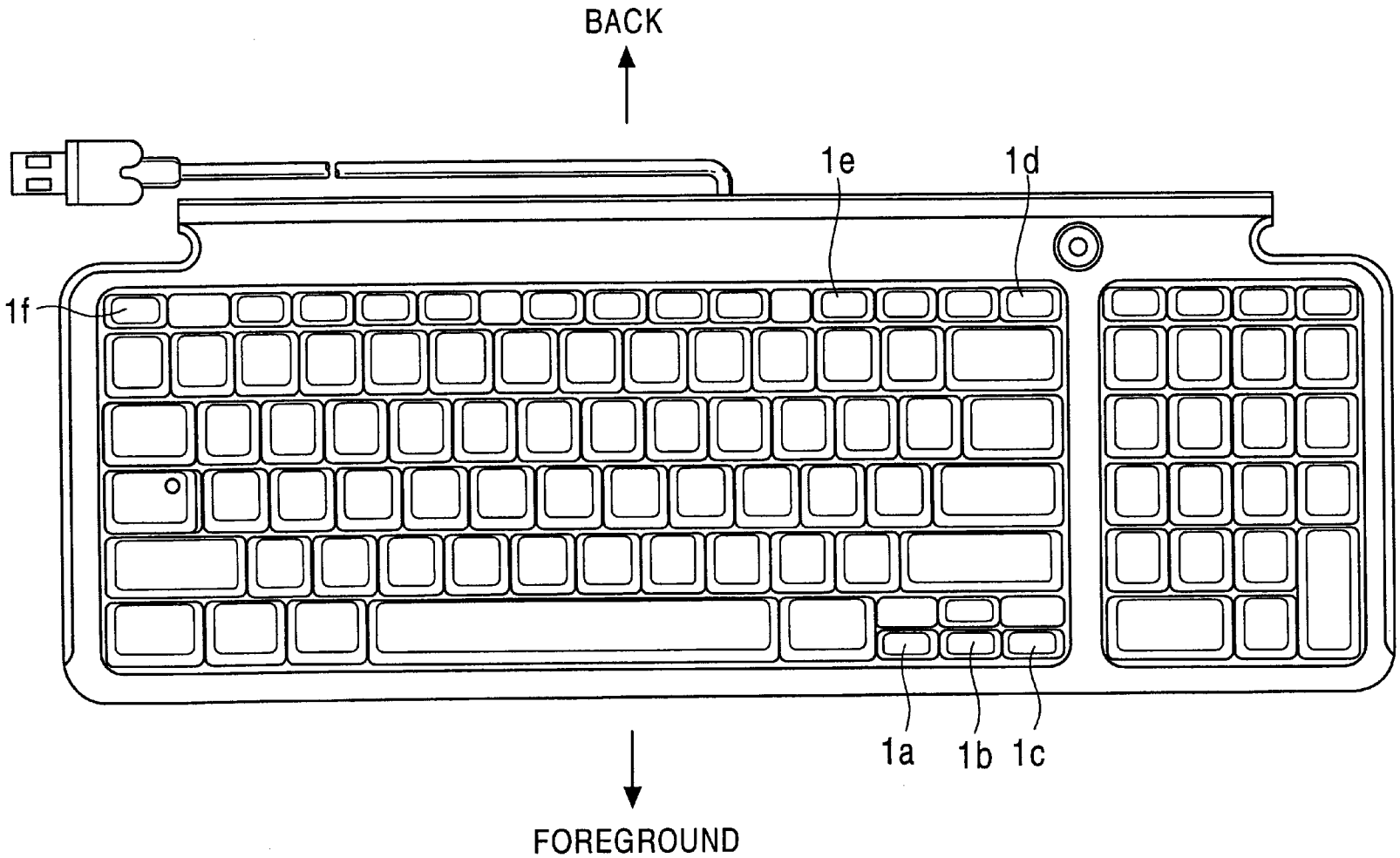
FIG. 1 is a plan view of a keyboard apparatus according to an embodiment of the present invention.

FIG. 1 shows an example of a keyboard apparatus according to the present invention, on which numerous key-switches each having a different function are arranged. Among these key-switches, each of key-switches 1*a*, 1*b*, 1*c*, 1*d*, 1*e*, and 1*f*, called half-keys, has a different type of key-top.

Figure 2:
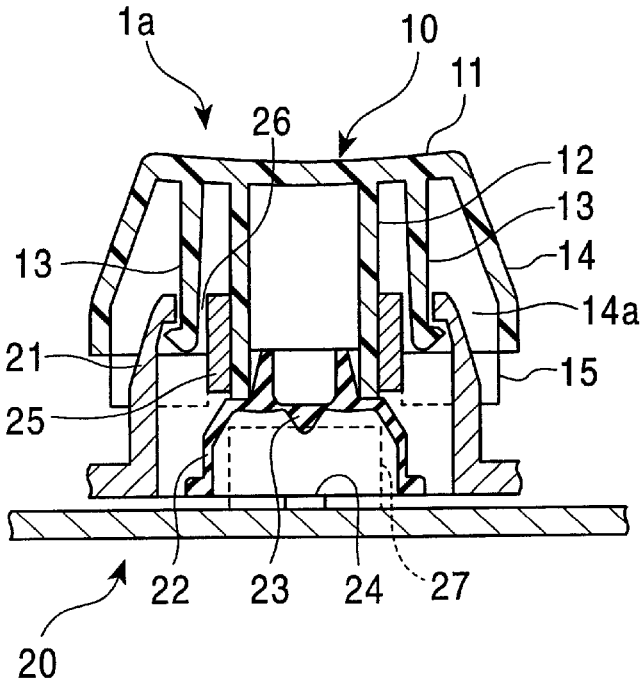
FIG. 2 is a sectional view of a key-switch according to the embodiment.

Among these key-switches 1*a* to 1*f*, the key-switch 1*a*, for example, comprises a key-top 10 and a body 20 as shown in FIG. 2. The key-top 10 comprises a stem portion 12 extending below the center portion of a rectangular top plate 11 with rounded corners thereof, a hook portion 13 disposed in the both sides of the stem portion 12 sandwiched therebetween, a side wall 14 extending below the periphery of the top plate 11, and a key-top side assortment cord portion 15 extending further below a side wall 14*a* of the side wall 14 in the keyboard back side.

The body 20 comprises a housing 21 accommodating the body 20, a rubber spring 22 connected to the bottom end of the stem portion 12 having a shape of a bowl inverted on the surface, and a membrane switch 24 disposed underneath a pushing portion 23 of the rubber spring 22, being formed below the center apex of the rubber spring 22. In the housing 21 formed are a socket 25 into which the stem portion 12 is vertically slidably inserted, a hook holding hole 26 with which the hook portion 13 engages so that the key-top 10 cannot be pulled out from the body 20, and a body side assortment cord portion 27 extending upward from the bottom end of the housing in an opposing relationship with the key-top side assortment cord portion 15.

Figure 3:
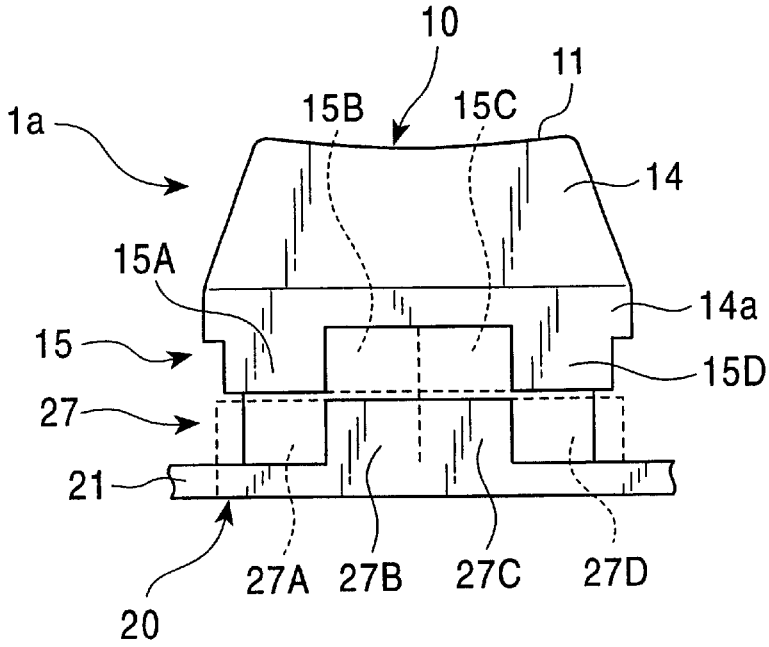
FIG. 3 is a side view of the key-switch shown in FIG. 2.

As shown in FIG. 3, the key-top side assortment cord portion 15 is laterally divided into four sections forming bits 15A, 15B, 15C, and 15D, respectively. The bits in both end 15A and 5D form convex portions downward, while the intermediate bits 15B and 15C form concave portions. Thereby, a key-top side assortment cord is formed of a combination of the convex portions and the concave portions, which is determined by the type of key-top.

On the other hand, the body side assortment cord portion 27 opposing the key-top side assortment cord portion 15 is lateraLly divided into four sections forming bits 27A, 27B, 27C, and 27D, respectively. The bits in both end 27A and 27D are to be concave portions while the intermediate bits 27B and 27C are to be convex portions to form a body side assortment cord formed of a combination of the convex portions and the concave portions, which mates with the key-top side assortment cord.

When fitting the key-top 10 to the body 20, first the end of the stem portion 12 is inserted into the socket 25 and the key-top 10 will be pushed downward in this state. At this time, the convex bits 15A and 15D of the key-top side assortment cord portion 15 are inserted into the concave bits 27A and 27D of the body side assortment cord portion 27, respectively, while the convex bits 27B and 27C of the body side assortment cord portion 27 are inserted into the concave bits 15B and 15C of the key-top side assortment cord portion 15, respectively. Therefore, the key-top side assortment cord mates with the body side assortment cord. These assortment cords do not interfere with insertion of the key-top 10. Accordingly, the fitting is completed when the key-top 10 is pushed down until the hook portion 13 is inserted into the hook holding hole 26.

Figure 4:
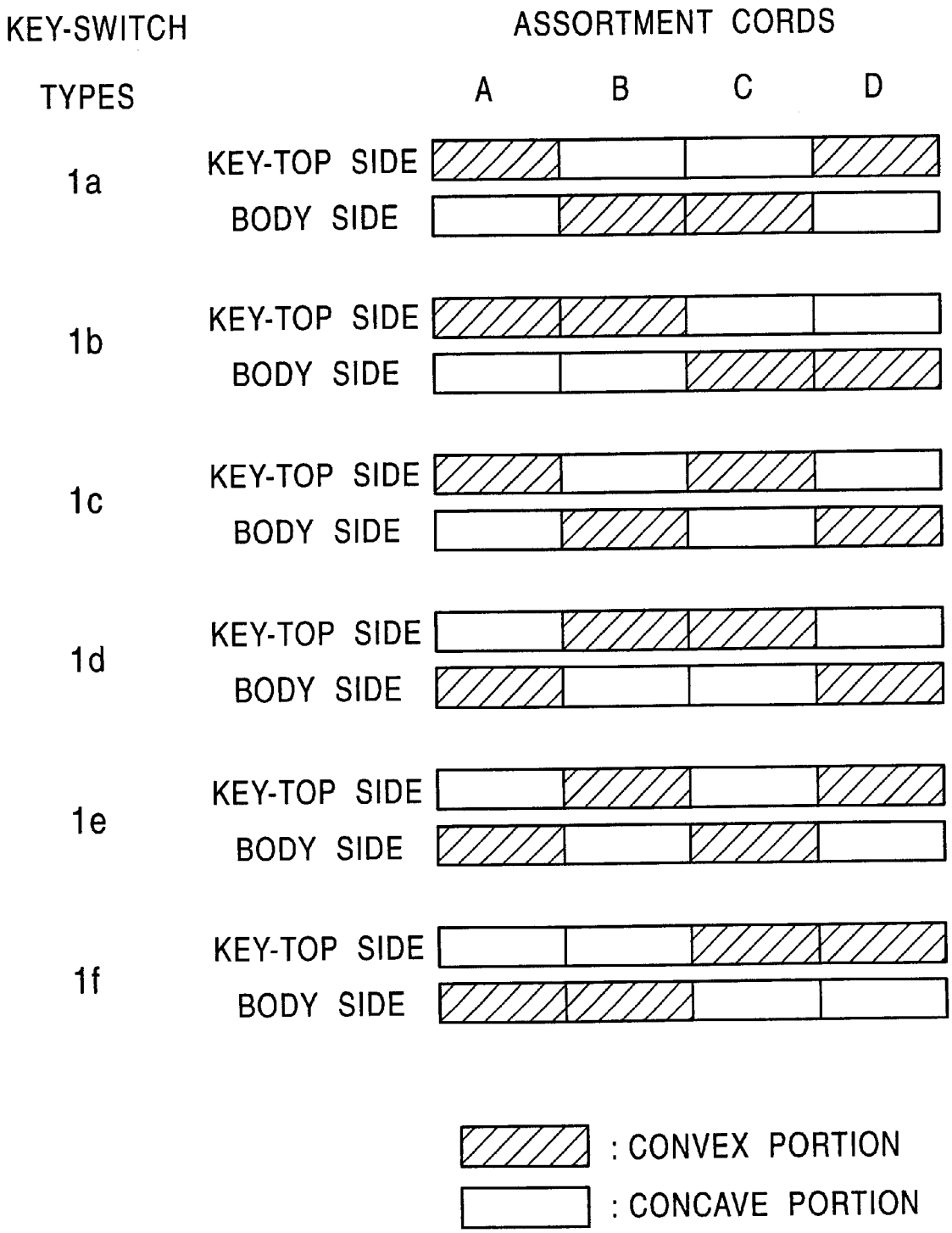
FIG. 4 shows assortment cord patterns used in the key-switch shown in FIG. 2.

The above is a description with respect to the key-switch 1*a*. Like in the key-switch 1*a*, in both of the key-top side and the body side, other key-switches 1*b*, 1*c*, 1*d*, 1*e*, and 1*f* have assortment cord portions, each portion being divided into four bits to form a combination of convex and concave portions. The assortment cord portion of one side is mated with that of another side. As shown in FIG. 4, each of these assortment cord portions is given an assortment cord which has a specifically different cord pattern in accordance with the type of the key-switch.

As it is apparent from FIG. 4 that if the key-top for the key-switch 1*b* is intended to fit wrong to the key-switch 1*a*, for example, it cannot be inserted because the bits of the "B" place of the assortment cord are both convex and are urged in contact with each other. Likewise, the key-tops of key-switches 1*c* to 1*f* cannot be also fitted to the body of the key-switch 1*a* because any of bits of the "B" or "C" places of the assortment cord is convex. The situation is also the sam with respect to other key-switches 1*b* to 1*f*.

In this manner, only when the key-top side assortment cord portion is mated with the body side assortment cord portion, a key-top can be fitted to each respective body, and the key-top cannot be inserted into the body otherwise. This results in preventing a mistake that a different type key-top is incorrectly fitted.

(Second Embodiment)

Figure 5:
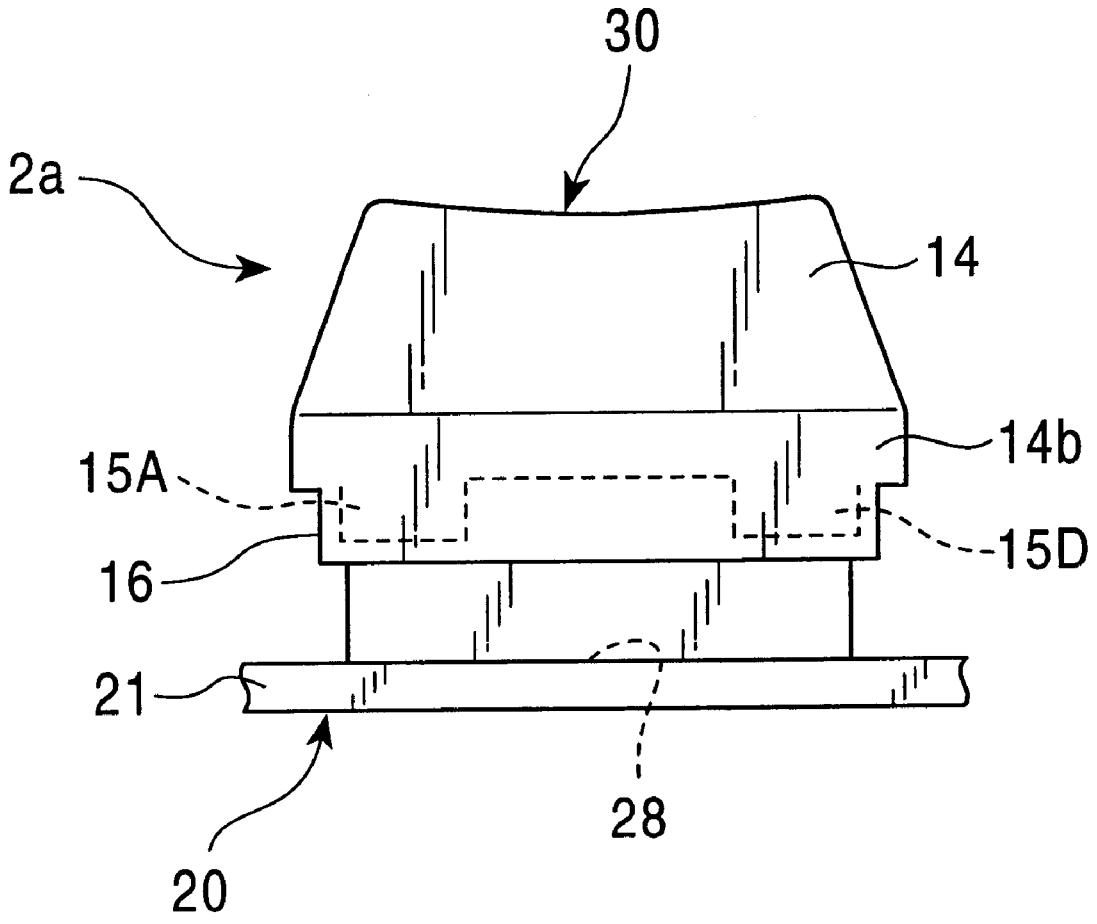
FIG. 5 is a side view of a key-switch according to another embodiment of the present invention.
Figure 6:
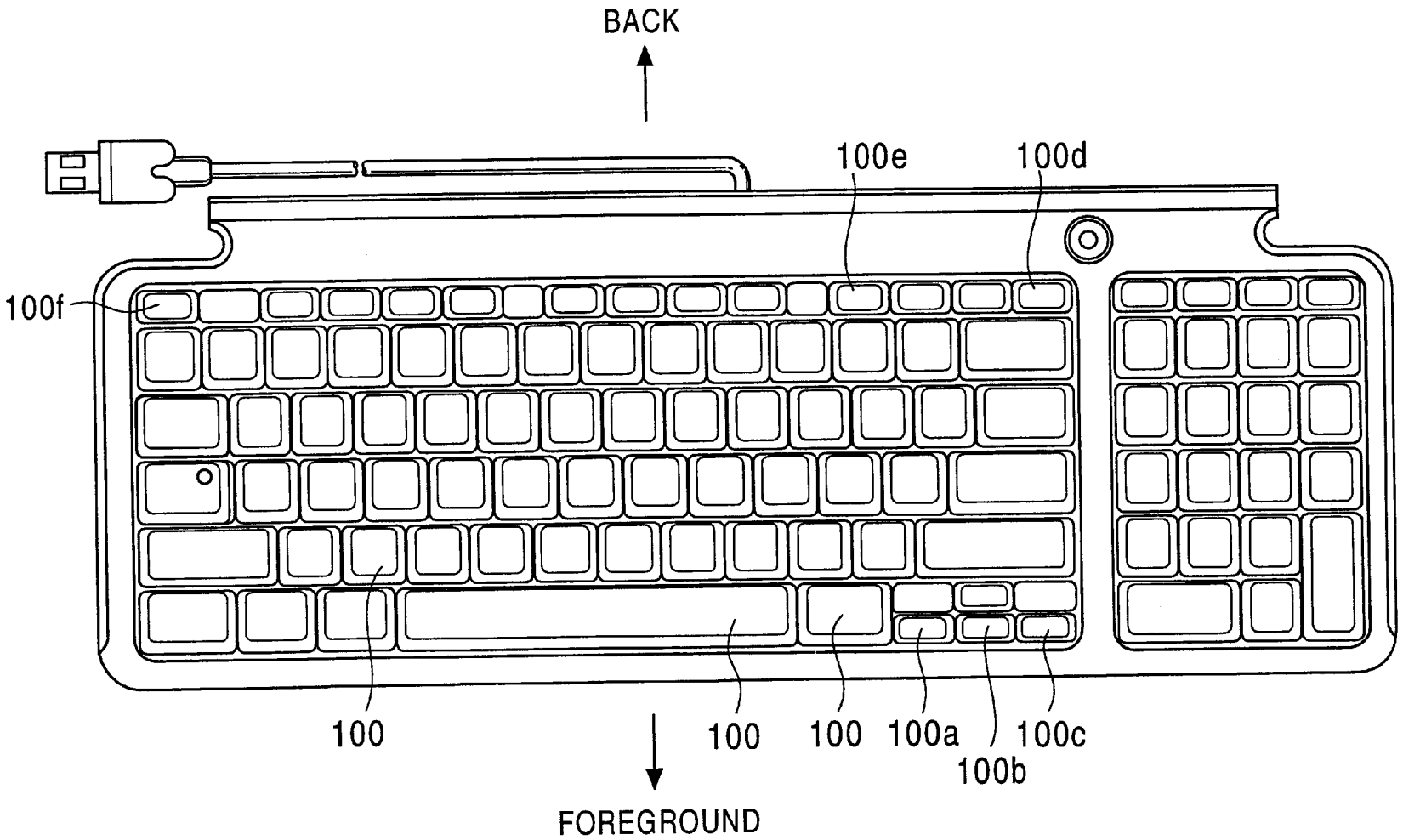
FIG. 6 PRIOR ART
FIG. 6 is a plan view showing an example of a conventional keyboard apparatus.

As shown in FIG. 5, a key-switch 2*a* according to another embodiment of the present invention is the same as the key-switch 1*a* of the first embodiment except for having a direction lord portion 16 which extends further below a side wall 14*b* of a key-top 30 in the keyboard foreground side. The key-switch 2*a* can be substituted for the key-switch 1*a* to be arranged in a keyboard apparatus according to the present invention.

In the key-switch 2*a*, the configuration of a body 20 is the same as that of the key-switch 1*a* according to the first embodiment, and there is nothing in a housing 21 just underneath the direction cord portion 16, which does not interfere the downward movement of the key-top 30. That is, this portion can be regarded as a concave portion forming a body side direction cord portion 28. On the other hand, when the key-top 30 is inserted in the inverted direction into the body 20, the direction cord portion 16 formed in the side wall 14*b* of the key-top 30 is to be urged in contact with a convex portion of the body side direction cord portion 28 formed in the housing in the back side of the keyboard.

This key-top 30 can be fitted to the body 20 depending only on an engagement relationship between the assortment cords, as long as it is correctly inserted in back and foreground directions. However, when the key-top 30 is inversely inserted in back and foreground directions, regardless of an engagement relationship between the assortment cords, the direction cord portion 16 is urged in contact with a convex portion of a body side assortment cord portion 27 so as not to be inserted. Thereby, the key-top can be prevented from being inversely fitted to the body by mistake.

Since the direction cord portion 16 is simply formed as an extension of the side wall 14*b* in the foreground side of the keyboard and cannot be also in sight from outside, it is easily formed without loss of design and appearance thereof. Furthermore, since the direction cord portion 16 is formed in the foreground side of the key-top, when the key-top is fitted to the body, discrimination between back and foreground directions can be achieved by a visual check before insertion, resulting in preventing a fitting mistake in advance.

In the first or second embodiment, although the assortment cord portion and the direction cord portion are formed in a plate shape, they are not particularly limited to the shape. For example, the convex portion may be formed in a pin shape. Although it is preferable that the assortment cord portion be formed in the back side of the key-switch while the direction cord portion be formed in the foreground side, the layout is not particularly limited. The number of bits (divided sections) of the assortment cord depends on t he number of types of the key-top. It is needless to say that the cord patterns thereof be not limited to those in the above-described embodiments.

In the keyboard apparatus according to the present invention, since the key-top can be fitted to the body only when the key-top side assortment cord is mated with the body side assortment cord, a mistake that a different type of key-top is wrong fitted to a specific type of body can be prevented. When the key-switch has the direction cord as well as the assortment cord, a mistake that the key-top is fitted in a wrong direction can be also prevented.

What is claimed is:

1. A keyboard apparatus comprising:

a keyboard base;

key-switch bodies arranged on said keyboard base; and key-tops corresponding to said key-switch bodies, each of said key-tops including a key-top side assortment cord having a first unique combination of convex portions and concave portions which is determined by a type of key-top thereof, and each of said key-switch bodies including a body side assortment cord having a second unique combination of convex portions and concave portions engageable with the key-top side assortment cord, wherein said key-tops are fittable to said key-switch bodies only when the key-top side assortment cord is brought into engagement with the body side assortment cord, the key-top side assortment cord is formed below a portion of a side wall of each of said key-tops, and the body side assortment cord is formed above a housing of each of said key-switch bodies.

2. A keyboard apparatus comprising:

a keyboard base;

key-switch bodies arranged on said keyboard base; and key-tops corresponding to said key-switch bodies, each of said key-tops including a key-top side assortment cord having a first unique combination of convex portions and concave portions which is determined by a type of key-top thereof, and each of said key-switch bodies including a body side assortment cord having a second unique combination of convex portions and concave portions engageable wit the key-top side assortment cord, wherein said key-tops are fittable to said key-switch bodies only when the key-top side assortment cord is brought into engagement with the body side assortment cord, each of said key-tops further comprises a key-top side direction cord to define a fitting direction disposed in a different position from that of the key-top side assortment cord having one of a convex portion and a concave portion, and each of said key-switch bodies further comprises a body side direction cord disposed in an engaging position with the key-top side direction cord having one of a convex portion and a concave portion, and wherein said key-tops are fittable to said key-switch bodies only when the key-top side direction cord is brought into engagement with the body side direction cord.

3. A keyboard apparatus according to claim 2, wherein the key-top side direction cord is formed in one of a foreground position of said keyboard base and a bask position thereof.

* * * * *

UNITED STATES PATENT AND TRADEMARK OFFICE

CERTIFICATE OF CORRECTION

PATENT NO. : 6,297,809 B1
DATED : October 2, 2001
INVENTOR(S) : Hideki Ito

It is certified that error appears in the above-identified patent and that said Letters Patent is hereby corrected as shown below:

Claim 2,
Line 11, delete "wit" and substitute -- with -- in its place.

Signed and Sealed this

Ninth Day of April, 2002

*Attest:*

*Attesting Officer*

JAMES E. ROGAN
*Director of the United States Patent and Trademark Office*